US007844067B2

(12) United States Patent
Lowell et al.

(10) Patent No.: US 7,844,067 B2
(45) Date of Patent: Nov. 30, 2010

(54) UNIVERSAL HORN SPEAKER

(75) Inventors: Wilhelm R. Lowell, St. Louis, MO (US); John J. Lowell, St. Louis, MO (US); Kevin Ditch, Oakville, MO (US); Jeffrey R. Garstick, Ballwin, MO (US)

(73) Assignee: Lowell Manufacturing Company, Pacific, MO (US)

( * ) Notice: Subject to any disclaimer, the term of this patent is extended or adjusted under 35 U.S.C. 154(b) by 1140 days.

(21) Appl. No.: 11/375,967

(22) Filed: Mar. 15, 2006

(65) Prior Publication Data

US 2006/0213718 A1 Sep. 28, 2006

Related U.S. Application Data

(60) Provisional application No. 60/662,485, filed on Mar. 16, 2005.

(51) Int. Cl.
*H04R 25/00* (2006.01)

(52) U.S. Cl. ..... 381/340; 381/337; 381/386

(58) Field of Classification Search ..... 381/386–389, 381/391, 394–395, 189, 396, 433, 124, 337–340; 181/150, 199
See application file for complete search history.

(56) References Cited

U.S. PATENT DOCUMENTS

| | | | | |
|---|---|---|---|---|
| 4,123,621 | A * | 10/1978 | Walker | 181/150 |
| 5,937,073 | A * | 8/1999 | Van Gieson | 381/386 |
| 2003/0035563 | A1 * | 2/2003 | Chen | 381/386 |
| 2005/0201571 | A1 * | 9/2005 | Saint-Vincent et al. | 381/386 |

* cited by examiner

*Primary Examiner*—Suhan Ni

(57) ABSTRACT

A universal speaker horn assembly includes a speaker horn sized and shaped to fit into a four inch deep space and connectors which are adjustable to such an extent to permit the speaker horn to be mounted to substantially any site, regardless of desired speaker position and building construction material. A grille press-fits to the front of the horn and a trim ring hides connectors from an optional trim plate to an optional back box. Speaker controls can be accessed from the rear or front of the system.

20 Claims, 8 Drawing Sheets

UNIVERSAL HORN SPEAKER

CROSS-REFERENCED TO RELATED APPLICATION

This application is based upon and claims the benefit of U.S. Provisional Patent application No. 60/662,485, filed Mar. 16, 2005.

BACKGROUND OF THE INVENTION

1. Field of the Invention

The present invention relates to speakers for sound systems, and, more particularly, to a re-entrant horn-type paging speaker which has universal mounting applications.

2. Related Art

Previous horn type paging speakers have been limited in usage due in part to limitations in their mounting mechanisms and further in view of their cosmetic appearance. Generally such horn speakers have been very obtrusive, visually, being connected beneath a ceiling or from a wall and projecting outwardly and/or downwardly into a room, and having some or all of the mounting hardware clearly visible.

Known horn speakers generally require a back box of at least six inches in depth, to be large enough to accommodate the speaker. Thus, a ceiling plenum or interior wall depth sufficient to retain the backbox is also required. In many cases, this much depth in the site structure is not available.

Heretofore, horn speakers have also only been accessible for volume adjustment from the front of the speaker. This limited access is sometimes very inconvenient.

SUMMARY OF THE INVENTION

The new horn speaker described herein is the first known re-entrant indoor/outdoor paging horn with universal mounting options. The term of art, "re-entrant," refers to the flared horn housing, as well as the facing internal speaker housing within the horn, where the internal horn projects the sound waves internally against the flared horn, and the flared horn in turn distributes those sound waves outwardly.

The new horn speaker assembly is simple and fast to install, even in spaces only four inches deep. It installs using clamps, screws or other suitable connectors into new or retrofit areas and includes an architectural aluminum trim ring and grille, although it will also accept conventional eight inch grilles and conventional backboxes. The new horn speaker features dual capacitor circuitry for standard paging or supervised use. It also permits facile two-wire hook-up to a rear access cable clamp. There is preferably provided a front accessible transformer selection switch and general weather-resistant assembly for indoor/outdoor use. Integral seismic tie-off brackets provide added stability to the installation.

A wide variety of applications and installations are available for the new universal horn speaker assembly. It can be installed in ceilings or walls either at the surface or in a recessed manner and can be mounted in sheetrock/plaster, brick or concrete blocks, with or without a shallow backbox, and in areas where a finished architectural appearance is desirable. Using adjustable clamps and screws, the 15 W, 105 dB horn is highly suitable for standard or supervised paging and signaling applications both indoors and outdoors, particularly in view of the weather resistant construction. Although the horn has depth of only about 3.36 inches, it is very precisely engineered and has such an array of features as to make it very versatile. It can be formed with a self-contained aluminum housing, contoured aluminum trim ring and preferably press-fit aluminum grille that projects only about 0.767 inches, so that there is effectively no visible hardware.

Accordingly, there has been a long-felt need in the industry for an economically manufactured horn paging speaker having the capability of being facilely mounted in a wide variety of positions and structural sites ("universally"), including being substantially hidden within a four inch ceiling plenum or wall space, and having a very acceptable cosmetic appearance, while still providing clear intelligibility, durable performance and architectural integrity.

Thus, in keeping with the goals and advantages described above the invention is, briefly, a universal horn speaker including a re-entrant indoor/outdoor paging speaker horn sized and shaped to fit into a four inch deep space, at least one transformer operatively connected within the speaker horn, and connectors which are adjustable to such an extent to permit the speaker to be mounted to substantially any site, regardless of desired speaker position and building construction material, and to thereby render the speaker mountable to a surface or in a space significantly less deep than conventionally used for mounting horn loudspeakers and, mountable in a building material selected from the group consisting of brick, concrete block, plaster, drywall, wood and ceiling tile.

The invention is still further, briefly a universal horn speaker as described above and also including transformer taps accessible from the back of the speaker.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
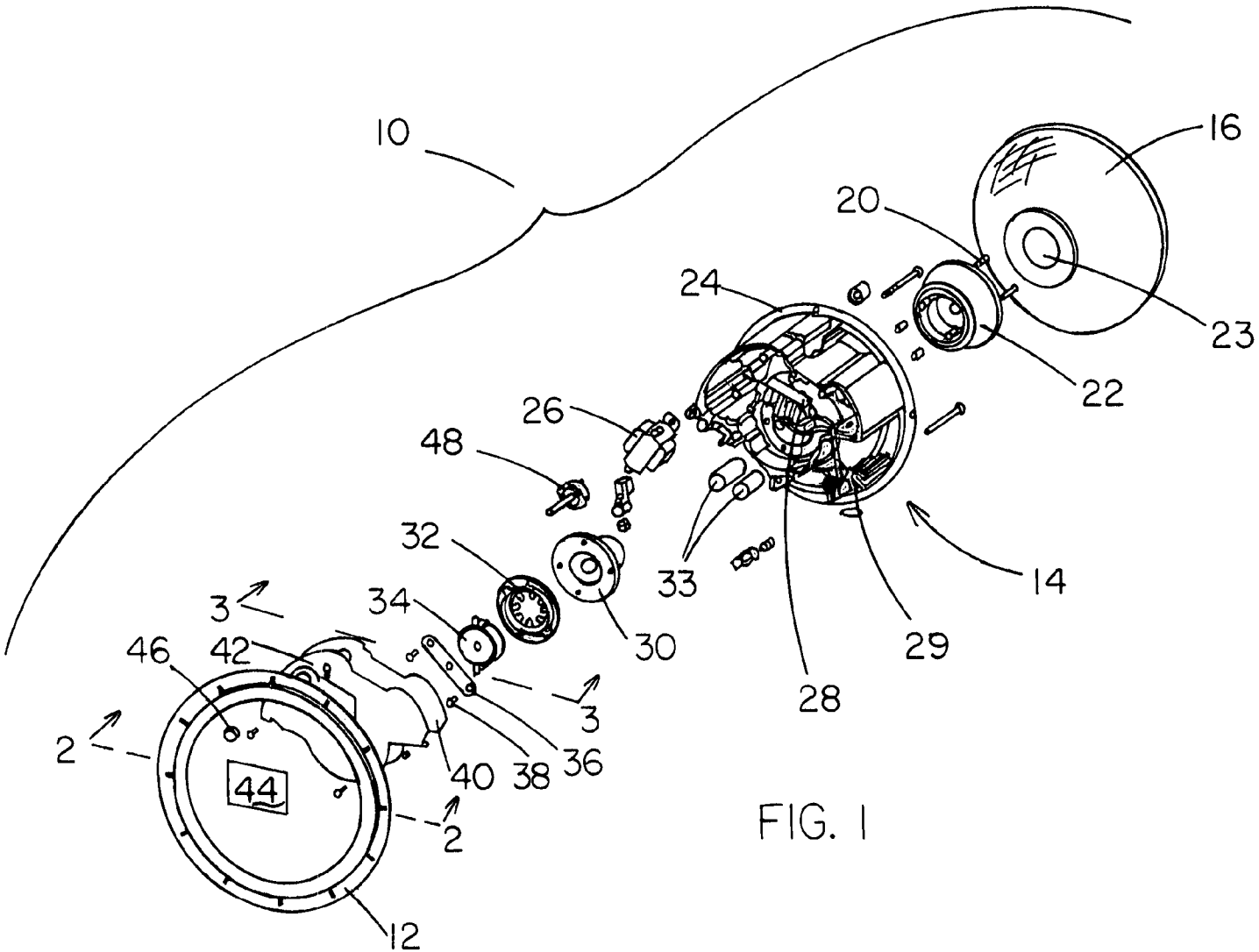
FIG. 1 is an exploded rear perspective view of the new universal horn speaker assembly constructed in accordance with and embodying the present invention with the cover plate and gasket in place.
Figure 5:
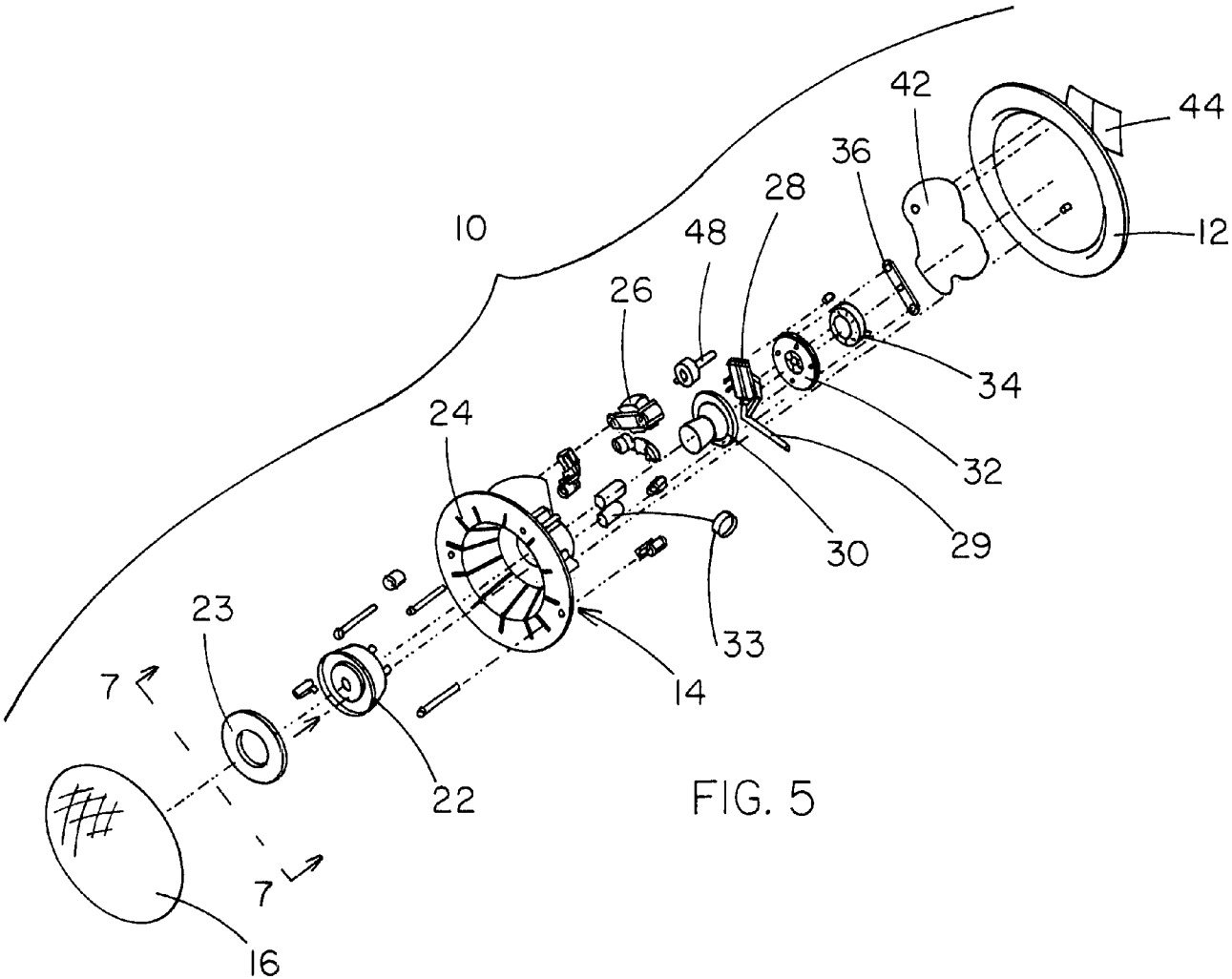
FIG. 5 is an exploded front perspective view of the entire universal horn speaker assembly of FIG. 1.

With reference to the attached drawings, a universal horn speaker assembly, generally designated 10, having universal mounting mechanisms, and acceptable variations thereon, is shown. Assembly 10 consists generally of a frame 12 supporting a horn housing 14, which is covered by a grill horn 16. An exploded view of assembly 10 from the rear is shown in FIG. 1 and an exploded view of the assembly from the front is seen in FIG. 5. It is to be understood that throughout this description "forward" or "front" refers to the grill end of the assembly and "rear" or "back" refers to the frame end of the system.

Figure 8:
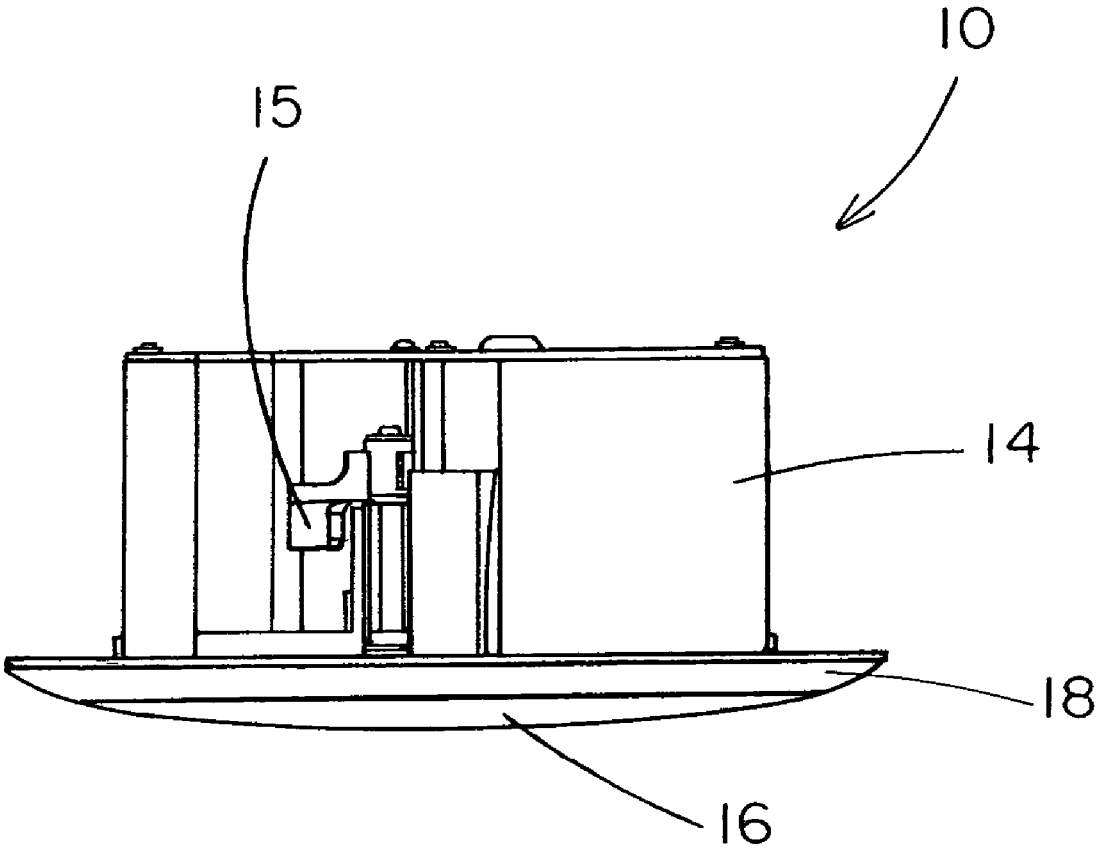
FIG. 8 is a side elevational view of the speaker assembly of FIG. 6, assembled and turned to a ceiling mount position.

More specifically, grill 16 can be mounted over the forwardly directed opening of horn housing 14, which is mounted by connectors 20 to a horn snout 22. A top cover plate 23 is mounted coaxially behind grill 16 over the forward facing opening of horn snout 22. Snout 22 is mounted centrally within housing 14, which is preferably mounted by an outer flange 24 to frame 12, by screws, clamps or other suitable connectors, or press-fit, as may be desired. It is preferred that a trim ring 18 (e.g. as shown in FIG. 8) be mounted, for example by snap-fitting, on the forward-most end of assembly 10 so as to hide from view any screw ends or other hardware used in installation of the system, such as may be used, for example, in mounting an optional trim plate to a back box for speaker assembly 10.

The rear side of the horn housing 14 is formed to receive a transformer 26 and a barrier connector 28 which is preferably, although not necessarily of the two term style. Barrier connector 28 and transformer 26 are attached by a two-wire wire 29. Preferably shrink-wrapped capacitors 33 are operatively connected within the electronic assembly of the new system, and as illustrated, can be mounted near barrier connector 28 within the rear area of the housing. The positions of these parts can be seen in FIGS. 1, 3 and 5, among others.

Figure 2:
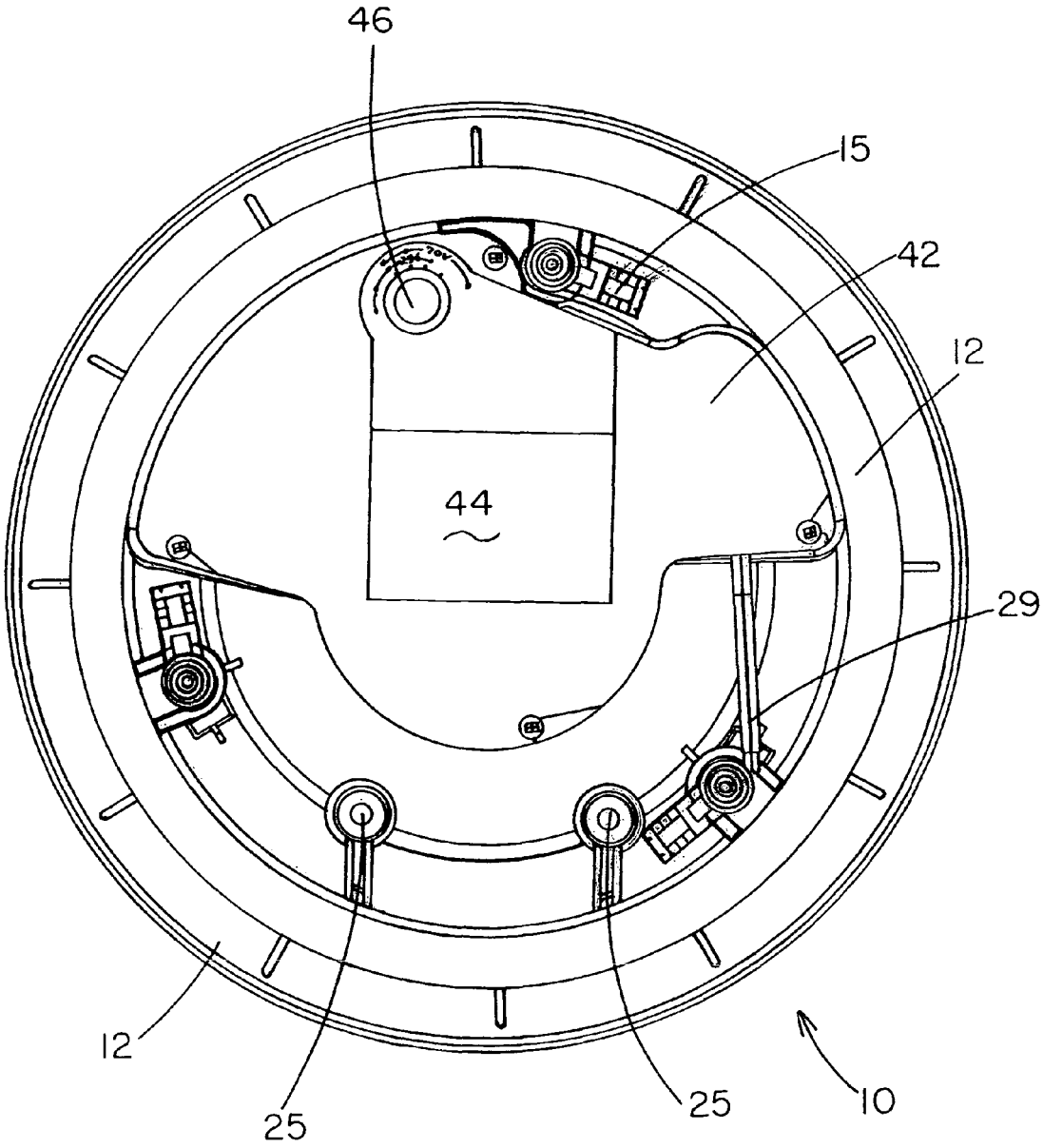
FIG. 2 is a rear end elevational view of the speaker assembly taken on line 2-2 of FIG. 1, enlarged.
Figure 3:
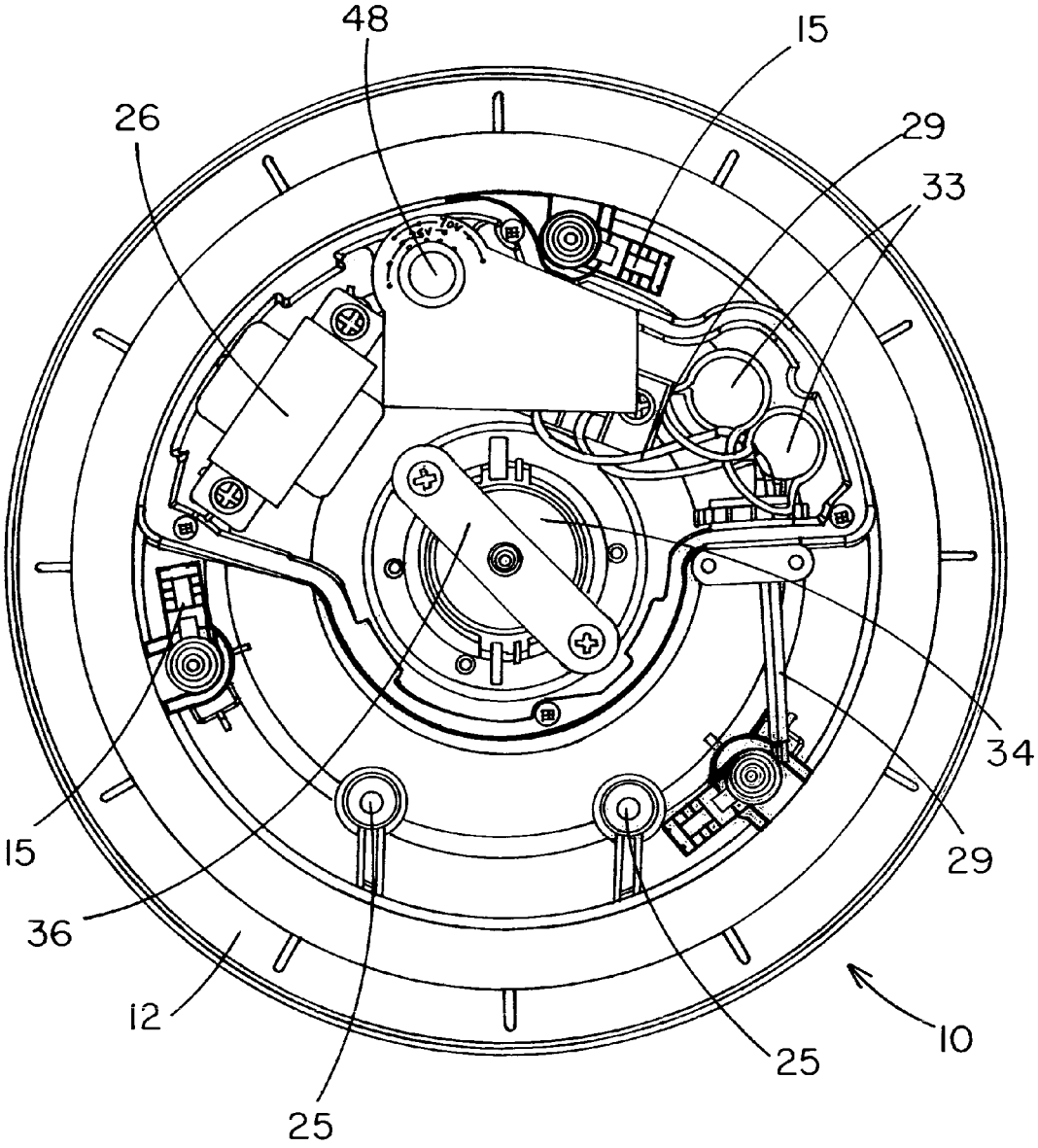
FIG. 3 is an end elevational view of the back of the speaker assembly taken approximately on line 3-3 of FIG. 1, enlarged, with the cover plate and gasket removed.
Figure 4:
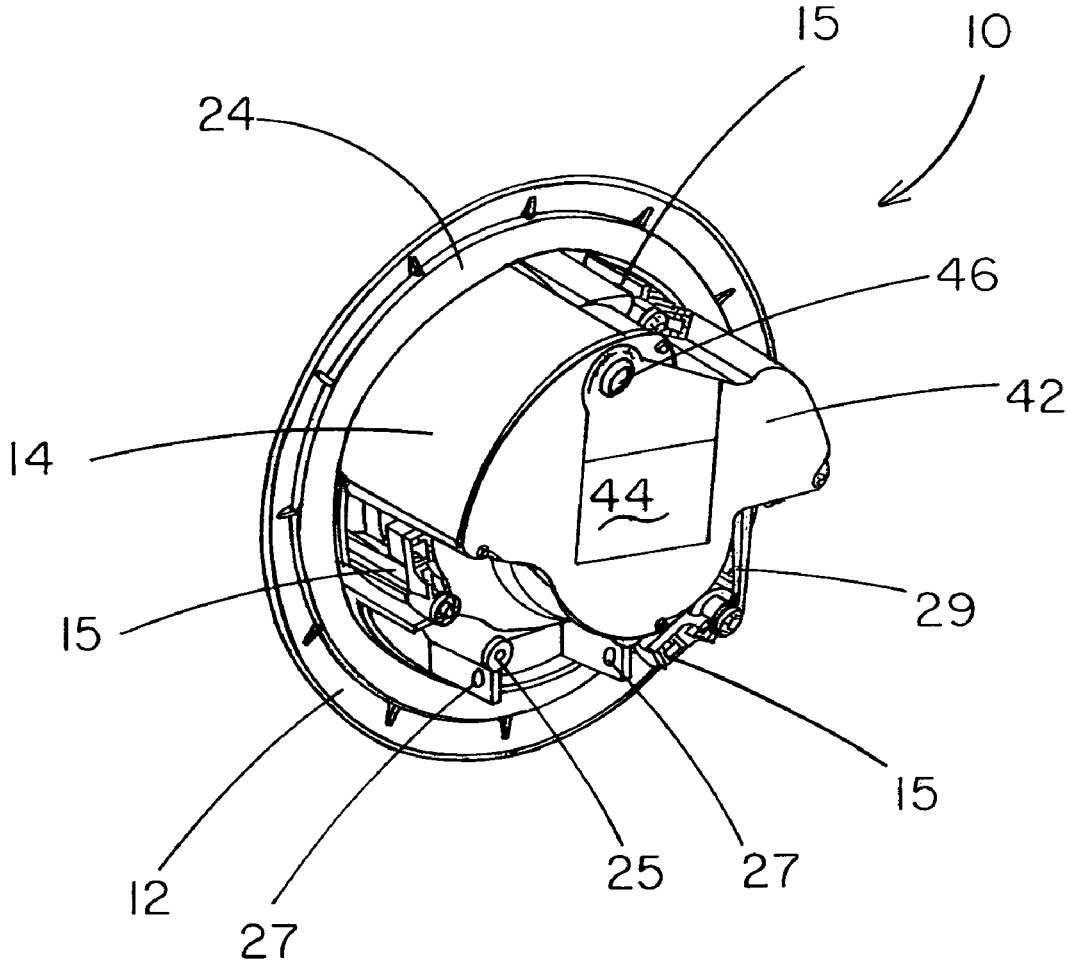
FIG. 4 is a rear perspective view of the speaker assembly of FIG. 1, assembled and enlarged for clarity.

FIGS. 2, 3 and 4 show the positions of threaded posts 25 and cable flying holes 27 are seen in FIG. 4. These posts 25 and holes 27 facilitate various mounting methods for the new universal speaker system 10. Likewise, swing-out mounting clamps 15, shown in FIGS. 2 and 3, include a dogging mechanism 31 and are preferably connected spacedly around the periphery of housing 14 and also facilitate adjustability and universal mounting of assembly 10.

An inner horn 30 is mounted coaxially to the back end of horn housing 14 and preferably has a phasing plug 32 and coaxial tweeter 34 mounted rearwardly thereon. A bracket 36 and suitable connectors, such as screws 38, secure the tweeter 34, phasing plug 32 and inner horn 30 against the back of housing 14.

Figure 7:
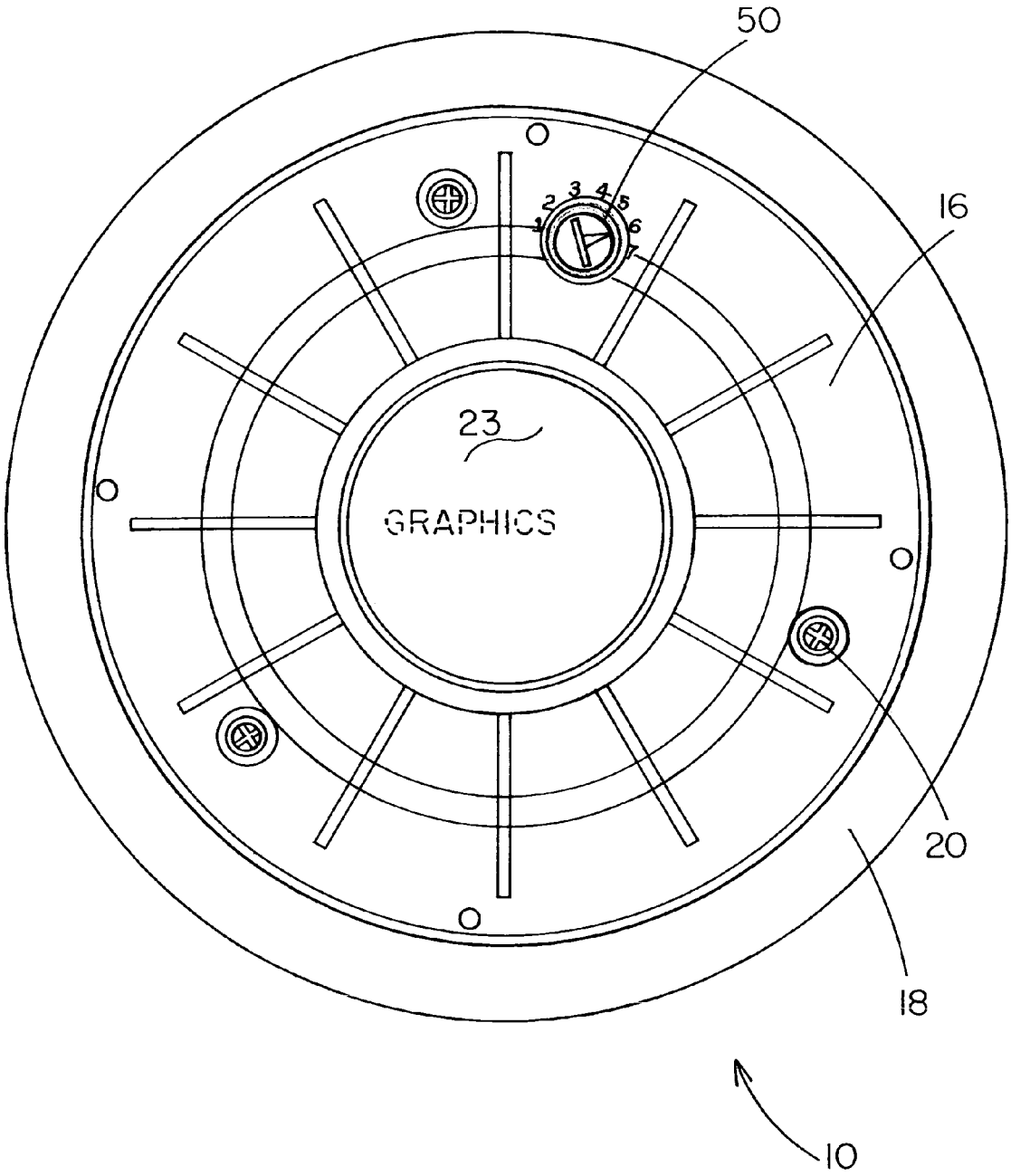
FIG. 7 is an end elevational view of the front of the speaker assembly of FIG. 1, enlarged, with the grille removed.

When viewed from the front, as in FIG. 7, with the grill 16 removed from assembly 10, a control switch knob 50 for transformer 26 is seen to be readily accessible for front access to control volume in universal horn speaker assembly 10.

Rearward of bracket 36 a gasket 40 optionally covers the back of the speaker assembly and is in turn over-laid by a back cover plate 42, which serves as a site to mount an information/instruction label, for example as indicated by 44. An opening is preferably provided in both the gasket 40 and cover plate 42 to accommodate a plug 46 which conceals and protects a switch 48 (transformer tap) that permits rear assembly control access. Thus, assembly 10 is preferably constructed so as to permit control access from both the front and the back of the assembly, although either front or back control alone can be provided.

The universal mounting options for horn speaker assembly 10 include (but are not necessarily limited to) the following:

a) mounting to a surface using the built-in adjustable swing-out clamps 15;

b) mounting to a surface by installing screws through the front face of the horn;

c) mounting by bolts that are arranged in a pattern that mate to the bolt pattern of any industry standard 8" speaker baffle or grill;

d) mounting by ¼"-20 rigging hardware attached to two (2) threaded posts 25 on the rear of the horn casting;

e) suspending with aircraft cable through two (2) cable flying holes 27 in the rear of the horn casting; and f) suspending with aircraft cable through installer supplied ¼"-20 eyebolts inserted in the two (2) threaded posts on the rear of the horn casting.

Figure 6:
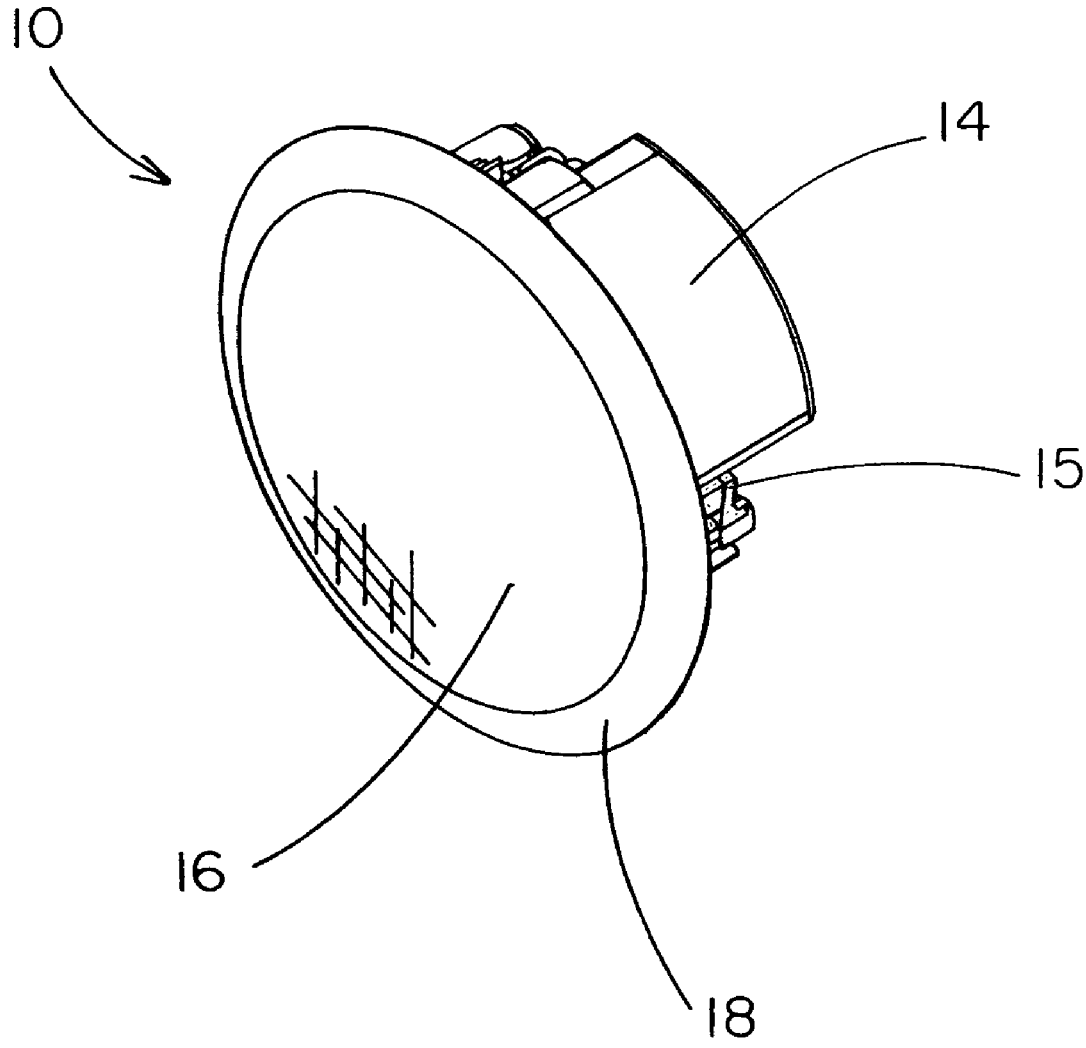
FIG. 6 is a front perspective view of the assembly of FIG. 5, assembled.

The speaker of the present invention is the first known re-entrant indoor/outdoor paging horn that includes a 70/25 dual-voltage transformer, and that is shallow enough to be installed in a 4" standard stud wall. It is also the first that includes an architectural, finely perforated screen with trim ring with no visible mounting hardware, as illustrated in FIG. 6. Further, there is no prior known re-entrant indoor/outdoor paging horn with a dual voltage (25V and 70.7V) transformer, such as that shown at 26, that has a tap select switch that is adjustable from the front and the rear of the horn, rather than only from the front as has been known. The new horn speaker assembly 10 is also the first known universal re-entrant indoor/outdoor paging horn with a built-in capacitor 33 (that allows the horn to be used in a "supervised" sound system or a non-supervised sound system), that is modular in nature and can be installed (1) as a stand-alone horn, (2) using industry standard 8" speaker enclosures, baffles, and grills, and (3) with the included separate trim ring with fine mesh grill.

The new horn speaker is preferably formed of aluminum with stainless steel hardware and a moisture-seal rear cover with a gasket to protect the speaker, especially in outdoor installations. Wiring connections are made by way of a rear-mounted cable clamp and a 25/70V transformer is screw-driver adjustable on the front of the unit. The total weight of the horn with the aluminum trim ring and grill is only about 3.7 pounds, and the finish is preferably a powder epoxy, although other finishes can be substituted without detracting from the invention.

The compression driver of the new universal horn speaker has a power rating of 15W, a frequency response of about 700 Hz to 8 kHz, plus or minus 6 dB, a dispersion of 85°, SPL 1W/1M; 105 dB, 1W/1M; 118 dB 15W/1M or 116 dB, 15W/10 ft. Impedance for the compression driver is available at levels of 5000, 2500, 1300, 666, 333, 89 and 45 Ohms. Power taps for 25V drivers are suggested at 0.48, 0.94, 1.8, 7.5 and 15W; or for 70V at 0.9, 1.8, 3.8, 7.5 and 15W.

The preferred overall size of speaker horn system 10, as an assembled unit, is approximately eight inches in diameter by about 3.36 inches in depth. The cut-out size for this unit is about seven inches in diameter.

Examples of various options considered for universal horn speaker system 10 include, but are not limited to: 1) All-in-one preferably stainless steel (or optional aluminum) surface/recessed box of 10.5" sq and four inch depth of with knock-outs on two sides and a universal read mounting pattern, the preferred finish in "Network Gray." 2) a beveled-edge aluminum trim plate (not shown), for example, one that is 11.5" square, will overlap of the horn box for a clean installation, required for recessed applications only; and 3) a tile bridge or known variety thereof is recommended to distribute the weight of the horn for in-ceiling installation applications. Further, if desired, the new horn speaker will mount standard accessories, such as eight inch speaker backboxes and eight inch grills if the factory-supplied trim ring and grill 16 are removed.

The above description of the preferred embodiment(s) is merely exemplary in nature and is in no way intended to limit the invention, its application, or uses.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A universal horn speaker comprising: a re-entrant indoor/outdoor paging speaker horn sized and shaped to fit into a four inch deep space, at least one transformer operatively connected within the speaker horn, and connectors which are adjustable to such an extent to permit the speaker to be mounted to substantially any site, regardless of desired speaker position and building construction material, and to thereby render the speaker mountable to a surface or in a space significantly less deep than conventionally used for mounting loudspeakers and selectively mountable in a building material selected from the group consisting of brick, concrete block, plaster, drywall, wood and ceiling tile.

2. The universal speaker horn of claim 1. and further comprising at least one transformer operatively connected within the horn so that the horn can he manufactured sufficiently small to fit into a four inch space.

3. The universal horn speaker of claim 1, and further comprising transformer taps accessible from the back of the speaker.

4. The universal horn speaker of claim 1, and further comprising transformer taps accessible from the front of the speaker.

5. The universal horn speaker of claim 1, and further comprising transformer taps accessible from the front of the speaker and transformer taps accessible from the back of the speaker horn to thereby provide facile adjustability of speaker volume.

6. The universal horn speaker of claim 1, and further comprising a dogging mechanism in communication with the adjustable connectors to facilitate adjustment of the fit of the horn into a pre-selected mounting site.

7. The universal horn speaker of claim 1, and further comprising a rear access cable clamp and two-wire electrical hookup to the rear access cable clamp to facilitate electrical connection of the speaker.

8. The universal horn speaker of claim 1, and further comprising a 25/70V transformer.

9. The universal horn speaker of claim 1, and further comprising dual capacitor circuitry for standard paging and supervised use.

10. The universal horn speaker of claim 1, and further comprising 105 dB speaker power level at 1W/1M to facilitate paging/signaling applications.

11. A universal horn speaker assembly comprising: a reentrant indoor/outdoor paging speaker horn sized and shaped to fit into a four inch deep space, at least one transformer operatively connected within the speaker horn, and connectors which are adjustable to such an extent to permit the speaker horn to be mounted to substantially any site, regardless of desired speaker position and building construction material and to thereby render the speaker mountable to a surface or in a space significantly less deep than conventionally used for mounting loudspeakers. and selectively mountable in a building material selected from the group consisting of brick, concrete block, plaster, drywall, wood and ceiling tile: and a grill which is formed to a suitable size and shape to press-fit to a front of the speaker.

12. The universal horn speaker assembly of claim 11, and further comprising a trim ring formed to clamp to a ceiling mounting site for the speaker.

13. The universal horn speaker assembly of claim 12, and further comprising a tile bridge to reduce stress on the ceiling site where the speaker assembly is installed.

14. The universal horn speaker assembly of claim 11, and further comprising a back box having about a four inch depth within which the speaker is received for mounting.

15. The universal horn speaker assembly of claim 14, and further comprising a trim plate connectable to the back box.

16. The universal horn speaker assembly of claim 15, and further comprising a trim ring on the speaker horn, the trim ring being connectable to the trim plate.

17. The universal horn speaker assembly of claim 15, and wherein the trim plate is connected by screws to the back box, and further comprising screws.

18. The universal horn speaker assembly of claim 16, wherein the trim ring is mountable so as to conceal the screws which connect the trim plate to the back box.

19. The universal horn speaker assembly of claim 11, and further comprising reversible clamps on the exterior of the speaker horn to provide depth adjustment capability to the assembly and thereby facilitate mounting of the assembly regardless of the depth of the mounting site space.

20. The universal horn speaker assembly of claim 11. and further comprising weather-proof construction so as to permit use of the assembly outdoors if desired.

* * * * *

UNITED STATES PATENT AND TRADEMARK OFFICE

CERTIFICATE OF CORRECTION

PATENT NO. : 7,844,067 B2
APPLICATION NO. : 11/375967
DATED : November 30, 2010
INVENTOR(S) : Wilhelm R. Lowell et al.

It is certified that error appears in the above-identified patent and that said Letters Patent is hereby corrected as shown below:

Col. 5, Lines 22-25
Delete Claim 2

Signed and Sealed this
Third Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,844,067 B2
APPLICATION NO. : 11/375967
DATED : November 30, 2010
INVENTOR(S) : Wilhelm R. Lowell et al.

It is certified that error appears in the above-identified patent and that said Letters Patent is hereby corrected as shown below:

Delete the title page and substitute therefore the attached title page showing the corrected number of claims in patent.

Col. 5, Lines 22-25
Delete Claim 2

This certificate supersedes the Certificate of Correction issued May 3, 2011.

Signed and Sealed this
Thirty-first Day of May, 2011

David J. Kappos

David J. Kappos
*Director of the United States Patent and Trademark Office*

(12) United States Patent
Lowell et al.

(10) Patent No.: US 7,844,067 B2
(45) Date of Patent: Nov. 30, 2010

(54) UNIVERSAL HORN SPEAKER

(75) Inventors: Wilhelm R. Lowell, St. Louis, MO (US); John J. Lowell, St. Louis, MO (US); Kevin Ditch, Oakville, MO (US); Jeffrey R. Garstick, Ballwin, MO (US)

(73) Assignee: Lowell Manufacturing Company, Pacific, MO (US)

( * ) Notice: Subject to any disclaimer, the term of this patent is extended or adjusted under 35 U.S.C. 154(b) by 1140 days.

(21) Appl. No.: 11/375,967

(22) Filed: Mar. 15, 2006

(65) Prior Publication Data

US 2006/0213718 A1 Sep. 28, 2006

Related U.S. Application Data

(60) Provisional application No. 60/662,485, filed on Mar. 16, 2005.

(51) Int. Cl.
*H04R 25/00* (2006.01)

(52) U.S. Cl. ..... 381/340; 381/337; 381/386

(58) Field of Classification Search ..... 381/386, 389, 381/391, 394–395, 189, 396, 433, 124, 337–340; 181/150, 199

See application file for complete search history.

(56) References Cited

U.S. PATENT DOCUMENTS

| | | | | |
|---|---|---|---|---|
| 4,123,621 | A * | 10/1978 | Walker | 181/150 |
| 5,937,073 | A * | 8/1999 | Van Gieson | 381/386 |
| 2003/0035563 | A1 * | 2/2003 | Chen | 381/386 |
| 2005/0201571 | A1 * | 9/2005 | Saint-Vincent et al. | 381/386 |

* cited by examiner

*Primary Examiner*—Suhan Ni

(57) ABSTRACT

A universal speaker horn assembly includes a speaker horn sized and shaped to fit into a four inch deep space and connectors which are adjustable to such an extent to permit the speaker horn to be mounted to substantially any site, regardless of desired speaker position and building construction material. A grille press-fits to the front of the horn and a trim ring hides connectors from an optional trim plate to an optional back box. Speaker controls can be accessed from the rear or front of the system.

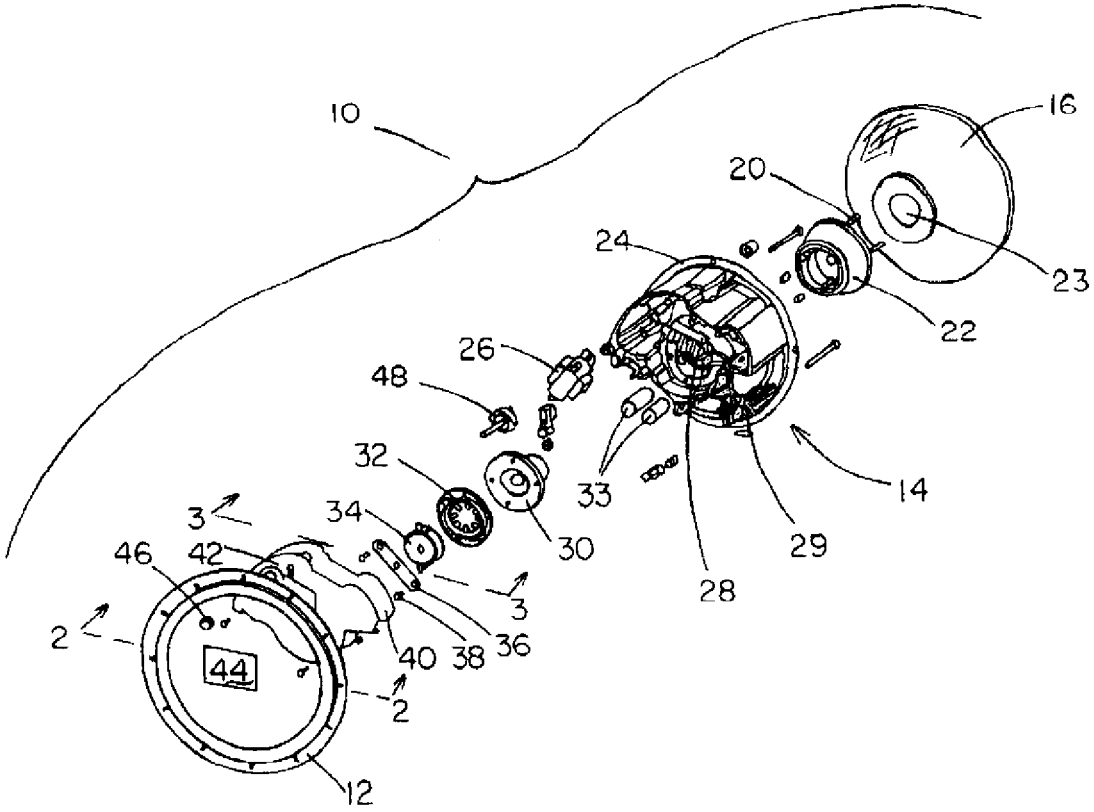

19 Claims, 8 Drawing Sheets